US009404722B2

(12) United States Patent
Pedersen

(10) Patent No.: US 9,404,722 B2
(45) Date of Patent: Aug. 2, 2016

(54) EXPANDABLE BROADHEAD WITH CHISEL TIP

(71) Applicant: Out RAGE, LLC, Cartersville, GA (US)

(72) Inventor: William E. Pedersen, Duluth, MN (US)

(73) Assignee: Out RAGE, LLC, Superior, WI (US)

( * ) Notice: Subject to any disclaimer, the term of this patent is extended or adjusted under 35 U.S.C. 154(b) by 0 days.

(21) Appl. No.: 14/626,035

(22) Filed: Feb. 19, 2015

(65) Prior Publication Data

US 2015/0168113 A1 Jun. 18, 2015

Related U.S. Application Data

(63) Continuation of application No. 13/792,989, filed on Mar. 11, 2013, now Pat. No. 8,986,141.

(60) Provisional application No. 61/740,008, filed on Dec. 20, 2012.

(51) Int. Cl.
*F42B 6/08* (2006.01)
*F42B 12/34* (2006.01)

(52) U.S. Cl.
CPC .. *F42B 12/34* (2013.01); *F42B 6/08* (2013.01)

(58) Field of Classification Search
CPC ..... F42B 6/08
See application file for complete search history.

(56) References Cited

U.S. PATENT DOCUMENTS 3,824,026 A 7/1974 Gaskins
4,212,463 A 7/1980 Repinski et al.
6,077,179 A 6/2000 Liechty, II
6,200,237 B1 3/2001 Barrie
6,258,000 B1 7/2001 Liechty, II
6,290,903 B1 9/2001 Grace, Jr. et al.
6,306,053 B1 10/2001 Liechty, II
6,322,464 B1 11/2001 Sestak
6,517,454 B2 2/2003 Barrie et al.
6,540,628 B1 4/2003 Musacchia, Jr.
6,595,881 B1 7/2003 Grace, Jr. et al.
6,626,776 B2 9/2003 Barrie et al.
6,887,172 B2 5/2005 Arasmith
6,910,979 B2 6/2005 Barrie et al.
6,966,856 B1 11/2005 Hajek
7,422,533 B1 9/2008 Johnson
D583,897 S 12/2008 Ward
7,771,297 B2 8/2010 Kuhn
7,951,023 B2 5/2011 Perkins, Jr.
8,197,367 B2 6/2012 Pulkrabek et al.
8,210,971 B1 7/2012 Fulton
RE44,144 E 4/2013 Barrie et al.
(Continued)

OTHER PUBLICATIONS

PCT International Search Report (PCT Article 18 and Rules 43 and 44) for PCT/US2013/076119, Mar. 11 2014.
(Continued)

*Primary Examiner* — John Ricci
(74) *Attorney, Agent, or Firm* — Covington & Burling LLP; Gregory S. Discher; Grant D. Johnson

(57) ABSTRACT

Designs for expandable broadhead arrowheads with chisel tips for attachment to arrow shafts are provided. The chisel tips, when inserted into the ferrules of the expandable broadheads, provide greater durability, improved flight characteristics for the projectile to which the broadheads are attached, and more effective deployment of the cutting blades of the expandable broadheads.

20 Claims, 16 Drawing Sheets

(56) References Cited

U.S. PATENT DOCUMENTS

| | | | | |
|---|---|---|---|---|
| 8,545,349 | B1 | 10/2013 | Budris et al. | |
| D710,962 | S | 8/2014 | Pedersen | |
| D711,489 | S | 8/2014 | Pedersen | |
| 8,986,141 | B2 * | 3/2015 | Pedersen | F42B 12/34 473/583 |
| 9,068,806 | B2 | 6/2015 | Pedersen | |
| 2002/0055404 | A1 | 5/2002 | Liechty | |
| 2002/0151393 | A1 | 10/2002 | Liechty | |
| 2007/0037640 | A1 | 2/2007 | Rager | |
| 2007/0161438 | A1 | 7/2007 | Fulton | |
| 2008/0254925 | A1 | 10/2008 | Odabachian et al. | |
| 2010/0113196 | A1 | 5/2010 | Jones | |
| 2012/0165142 | A1 | 6/2012 | Grace | |

OTHER PUBLICATIONS

PCT Written Opinion of the International Searching Authority (PCT Rule 43*bis*.1) for PCT/US2013/076119, Mar. 11, 2014.

PCT International Search Report (PCT Article 18 and Rules 43 and 44) for PCT/US2013/075782, Mar. 19, 2014.

PCT Written Opinion of the International Searching Authority (PCT Rule 43*bis*.1) for PCT/US2013/075782, Mar. 19, 2014.

PCT International Preliminary Report on Patentability for PCT/US2013/075782, Jun. 23, 2015.

PCT International Preliminary Report on Patentability for PCT/US2013/076119, Jul. 7, 2015.

* cited by examiner

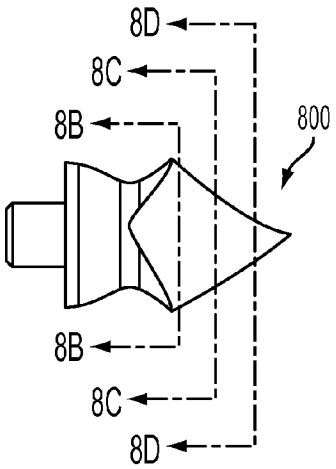
FIG. 8A
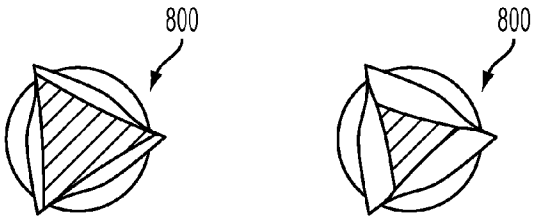
FIG. 8B
FIG. 8C
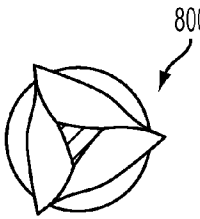
FIG. 8D
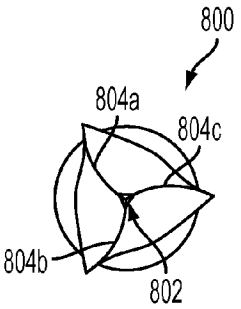
FIG. 8E
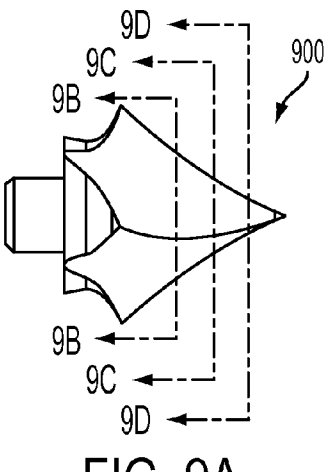
FIG. 9A
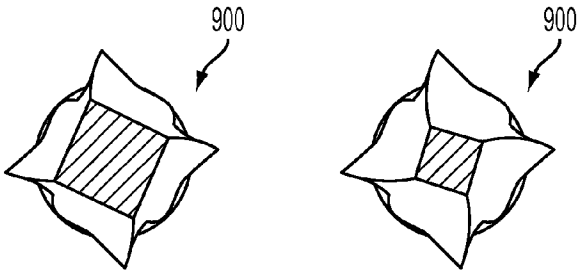
FIG. 9B
FIG. 9C
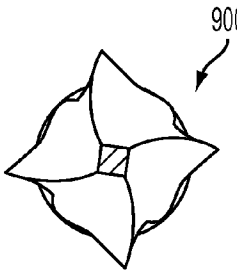
FIG. 9D
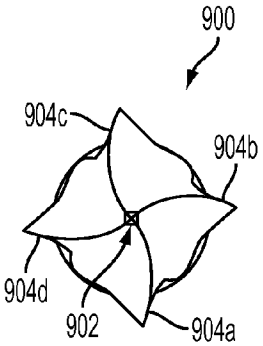
FIG. 9E

EXPANDABLE BROADHEAD WITH CHISEL TIP

CROSS-REFERENCE TO RELATED APPLICATIONS

This application is a continuation, and claims the benefit under 35 U.S.C. §120, of U.S. patent application Ser. No. 13/792,989, filed Mar. 11, 2013, which claims the benefit under 35 U.S.C. §119(e) of U.S. Provisional Patent Application No. 61/740,008, filed Dec. 20, 2012, each of which is herein incorporated by reference in its entirety.

TECHNICAL FIELD OF INVENTION

The present invention generally relates to arrowheads for attachment to arrow shafts and, more particularly, to expandable broadhead arrowheads with chisel tips.

BACKGROUND OF THE INVENTION

In an effort to develop ever-more effective equipment for hunting and other sports, the archery industry has developed a wide range of arrowhead styles that are intended and suited for specific uses. One such style of arrowhead is the broadhead, a bladed arrowhead featuring multiple sharp cutting blades that are designed to greatly increase the effective cutting area of the arrowhead. This increased cutting area results in larger, more effective entrance and exit wounds in game hit by the arrowhead, leading to quick and humane kills and better blood trails.

While broadheads provide an improved cutting capability in comparison with non-bladed arrowheads (known as field points or nib points), many broadhead designs suffer from inferior aerodynamic properties when compared to their non-bladed counterparts. Broadhead blades deployed during flight of an arrow can result in undesirable effects, causing that arrow to veer off course from the flight path coinciding with the longitudinal axis of the arrow shaft.

Previous broadhead designs have attempted to improve the aerodynamics of the bladed arrowheads by hiding a substantial portion of each of the cutting blades within the ferrule during flight of the arrow, in a design known as an "expandable broadhead." Upon impacting a target, the blades are deployed, opening up and exposing the sharp cutting surfaces of the blades. Examples of such previous expandable broadhead designs are described by U.S. Pat. No. 8,197,367, hereby incorporated by reference in its entirety, and are illustrated by the examples depicted in FIG. 1A, FIG. 1B, FIG. 1C, and FIG. 2. FIG. 1A, for example, depicts an existing expandable broadhead design 100 with two cutting blades 104*a* and 104*b*. These cutting blades are rear deploying blades held in place with a shock-absorbing retaining device 105 consisting of an O-ring and/or collar that is designed to break on impact. The rear deploying design of the blades 104*a-b* enhances the kinetic energy of the expandable broadhead 100 on impact, ensures that the blades 104*a-b* deploy reliably, and increases the probability of substantial penetration into the target. With regard to various exemplary embodiments of such collars, U.S. provisional patent application Ser. No. 61/584,430 (filed Jan. 9, 2012, entitled Broadhead Collars) and U.S. patent application Ser. No. 13/736,680 (filed Jan. 8, 2013, entitled Broadhead Collars), are both incorporated herein by reference in their entirety.

The design 100 illustrated by FIG. 1A also features a two-sided "cut on contact" tip 102, a sharpened double-edged piece of steel inserted into the nose of ferrule body 103. The cut on contact tip 102 is designed to slice neatly through the hide of a target game animal and requires a low amount of energy for penetration.

Previous designs for expandable broadheads have incorporated cut on contact tips similar to cut on contact tip 102 of broadhead 100. FIG. 1B depicts an example of an existing expandable broadhead design 106 that includes a ferrule body 107, a cut on contact tip 108, two rear deploying blades 110*a* and 110*b*, and collar 112 as disclosed in U.S. provisional patent application Ser. No. 61/584,430 and U.S. patent application Ser. No. 13/736,680.

FIG. 1C depicts an exploded view of an example of another existing expandable broadhead design 115. This design 115 features a cut on contact tip 117, two rear deploying blades 121*a* and 121*b*, and a collar 123. The cut on contact tip 117 is inserted into the ferrule body 120 and secured with a threaded fastener 116. The rear deploying blades 121*a-b* are hidden within one or more blade recesses 119 in the ferrule body 120, and secured to the ferrule body 120 by a threaded fastener 122. FIG. 2 depicts an example of yet another existing expandable broadhead design 200, which includes a cut on contact tip 203 and three rear deploying cutting blades 205*a*, 205*b*, and 205*c*.

Exemplary views of existing cut on contact tips are illustrated by FIGS. 3A-3C and FIGS. 4A-4C. FIG. 3A depicts a side view of cut on contact tip 300, FIG. 3B depicts a front view of cut on contact tip 300, and FIG. 3C depicts a top view of cut on contact tip 300. Similarly, FIG. 4A depicts a side view of cut on contact tip 400, FIG. 4B depicts a front view of cut on contact tip 400, and FIG. 4C depicts a top view of cut on contact tip 400.

While the cut on contact tips utilized by previous expandable broadhead designs can easily penetrate the hide of a targeted game animal with a low expenditure of kinetic energy, a need remains for an expandable broadhead design that features a chisel tip. Durability is one advantage provided by a chisel-tipped expandable broadhead, as the leading edge of the broadhead is the location most likely to sustain impact damage. The dense, sculpted chisel tip reduces the broadhead's susceptibility to such impact damage, especially when striking hard structures such as bone.

In addition to the chisel tip's resistance to impact damage, its comparatively large, dense structure increases the amount of mass in the nose of the expandable broadhead. This increase in density moves the center of mass of the projectile upon which the broadhead is mounted further forward, improving the flight characteristics of that projectile. The aerodynamics of the projectile upon which a chisel tip broadhead is mounted can be further improved by incorporating a spiraling, helical design for the chisel tip. This helical design directs air flow around the ferrule body of the broadhead, leading to increased rotation of the broadhead projectile and reducing the effects of side winds in flight. The effects of the directed air flow created by the chisel tip stabilize the flight path of the projectile to improve its flight characteristics and lead to enhanced accuracy and precision of arrow shots.

Furthermore, a chisel tip mounted on an expandable broadhead can result in an increase in the effectiveness of the deployment of the rear deployed cutting blades. The deployment of the cutting blades works best when the leading blunt edges of the retracted blades strike the hide of the targeted game animal on impact. By offsetting the alignment of the chisel tip's cutting edges with the alignment of the rear deployed cutting blades, the chisel tip ensures that the blunt edges of the retracted blades strike the animal's hide, causing the retracted blades to effectively deploy and expose their sharp cutting edges.

As discussed above, there is a need for an expandable broadhead design featuring a chisel tip that provides increased resistance to damage, results in improved flight performance, and aids in the effectiveness of deploying the expandable broadhead's cutting blades. Embodiments of the present invention, as described below, solve the need in the art for such a device.

SUMMARY OF THE INVENTION

Embodiments of the present invention are directed to expandable broadheads for attachment to arrow shafts. In one embodiment, the expandable broadhead includes a ferrule body that has a nose section and at least one blade recess, a chisel tip inserted into the nose section of the ferrule body, and a plurality of blades residing at least in part in the at least one blade recess. The plurality of blades can be configured in a retracted configuration or a deployed configuration, and a shock-absorbing retainer can be provided to releasably engage with the plurality of blades, to retain the blades in the retracted configuration until impact.

In certain embodiments of the invention, the ferrule body is composed of a material selected from the group consisting of aluminum, titanium, magnesium, and carbon-fiber reinforced polymer.

In certain embodiments of the invention, the chisel tip is made from a material selected from the group consisting of stainless steels, tool steels, carbides, titanium alloys, tungsten alloys, and tungsten carbides. In further embodiments of the invention, the chisel tip is coated with a material selected from the group consisting of nickel, zinc, cadmium, and black oxide.

In certain embodiments of the invention, the shock-absorbing retainer includes one or more devices selected from the group consisting of an O-ring and a collar.

In certain embodiments of the invention, each of the plurality of blades includes a cutting edge, and the cutting edge is exposed in the deployed configuration. In further embodiments of the invention, each of the plurality of blades includes a blunt edge, and the blunt edge is exposed in the retracted configuration.

In certain embodiments of the invention, the chisel tip is multi-faceted. In further embodiments of the invention, the number of facets of the chisel tip is a multiple of the number of the plurality of blades. In still further embodiments of the invention, the chisel tip is a three-facet chisel tip or a four-facet chisel tip, and the facets of the chisel tip are concave. In other further embodiments of the invention, the number of facets of the chisel tip is different than the number of blades.

In certain embodiments of the invention, the expandable broadhead further includes cutting edges between the facets of the chisel tip. In further embodiments of the invention, the cutting edges are helical blades. In further embodiments of the invention, the cutting edges of the chisel tip bisect the separation angles of the plurality of blades.

In certain embodiments of the invention, the expandable broadhead has a cutting diameter of about 1 inch to about 2.5 inches in diameter In certain embodiments of the invention, the expandable broadhead has a weight of about 75 grains to about 150 grains.

BRIEF DESCRIPTION OF THE DRAWINGS

FIG. 8A depicts an exemplary side view of a three-facet chisel tip.

FIG. 8B depicts an exemplary cross-section view of a three-facet chisel tip, along line 8B-8B of FIG. 8A.

FIG. 8C depicts an exemplary cross-section view of a three-facet chisel tip, along line 8C-8C of FIG. 8A.

FIG. 8D depicts an exemplary cross-section view of a three-facet chisel tip, along line 8D-8D of FIG. 8A.

FIG. 8E depicts an exemplary end view of FIG. 8A.

FIG. 9A depicts an exemplary side view of a four-facet chisel tip.

FIG. 9B depicts an exemplary cross-section view of a four-facet chisel tip, along line 9B-9B of FIG. 9A.

FIG. 9C depicts an exemplary cross-section view of a four-facet chisel tip, along line 9C-9C of FIG. 9A.

FIG. 9D depicts an exemplary cross-section view of a four-facet chisel tip, along line 9D-9D of FIG. 9A.

FIG. 9E depicts an exemplary end view of FIG. 9A.

DETAILED DESCRIPTION OF EMBODIMENTS OF THE INVENTION

Figure 1A:
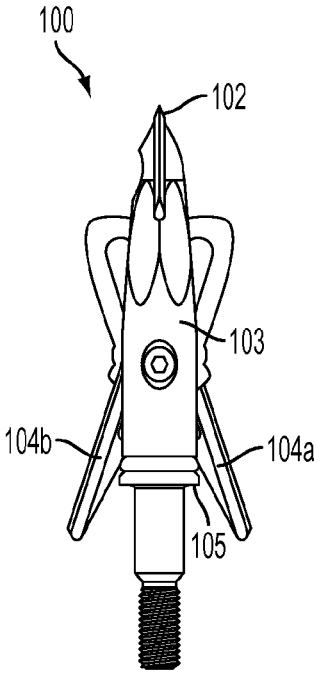
FIG. 1A is a side view of an existing expandable broadhead design with two side cutting blades, a collar, and a cut on contact tip.
Figure 1B:
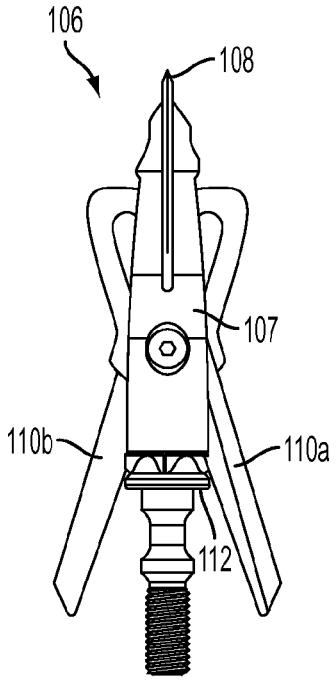
FIG. 1B depicts a side view of an existing expandable broadhead design with two side cutting blades, a collar, and a cut on contact tip.
Figure 1C:
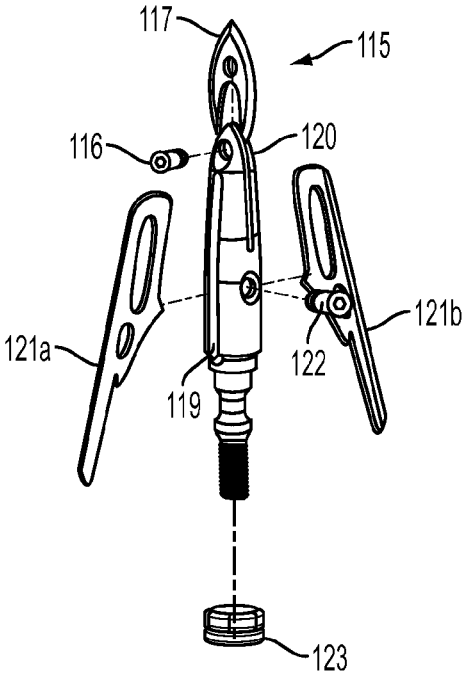
FIG. 1C depicts an exploded view of an existing expandable broadhead design with two side cutting blades, a collar, and a cut on contact tip.
Figure 2:
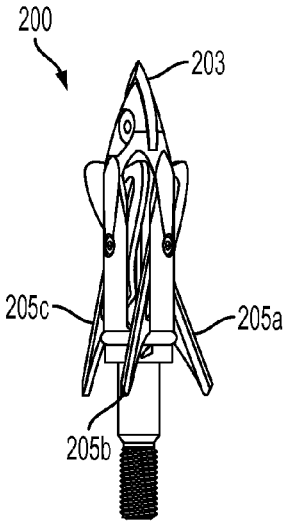
FIG. 2 depicts a perspective view of an existing expandable broadhead design with three side cutting blades, a collar, and a cut on contact tip.
Figure 3A:
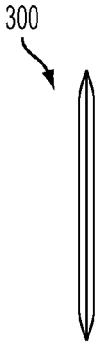
FIG. 3A depicts a side view of an existing cut on contact tip.
Figure 3B:
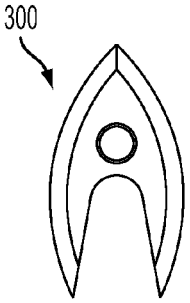
FIG. 3B depicts a front view of an existing cut on contact tip.
Figure 3C:
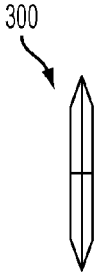
FIG. 3C depicts a top view of an existing cut on contact tip.
Figure 4A:
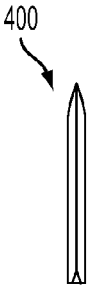
FIG. 4A depicts a side view of an existing cut on contact tip.
Figure 4B:
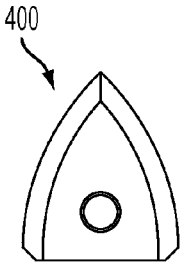
FIG. 4B depicts a front view of an existing cut on contact tip.
Figure 4C:
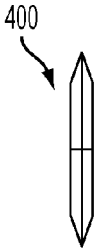
FIG. 4C depicts a top view of an existing cut on contact tip.
Figure 5A:
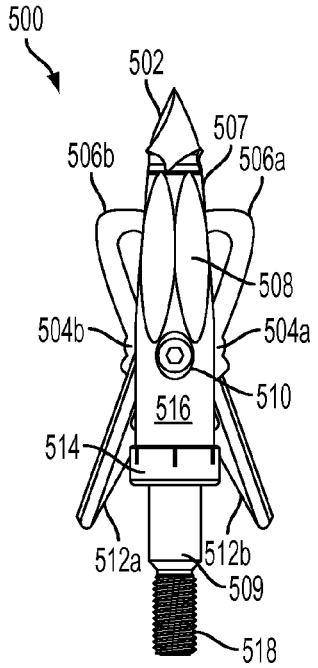
FIG. 5A depicts an exemplary side view of an expandable broadhead with a chisel tip, two side cutting blades, and a collar.
Figure 5B:
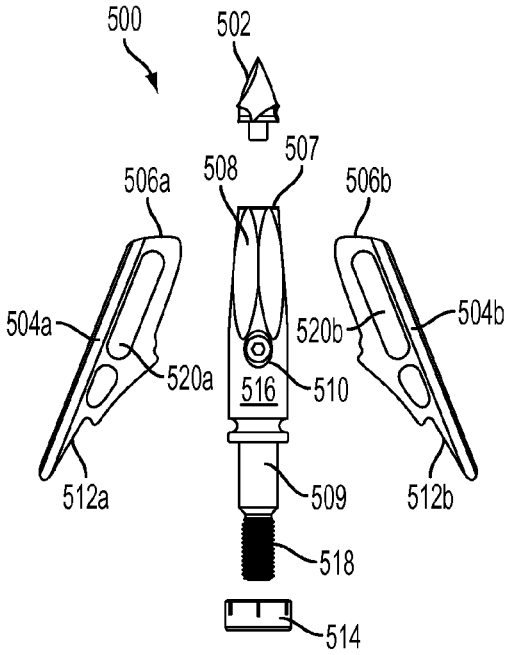
FIG. 5B depicts an exemplary exploded view of FIG. 5A.

Embodiments of the present invention pertain to and provide designs for expandable broadheads with chisel tips for attachment to arrow shafts. FIGS. 5A and 5B provide exemplary views of a preferred embodiment of the present invention. In this preferred embodiment of the present invention, the expandable broadhead design 500 includes a ferrule body 516. The ferrule body 516 includes at least one blade recess (such as shown in FIG. 11B), and the broadhead 500 further includes a chisel tip 502 inserted into the nose section 507 of the ferrule body 516, a plurality of blades 504*a* and 504*b* residing at least in part in the at least one blade recess, and a shock-absorbing retainer 514.

Figure 11A:
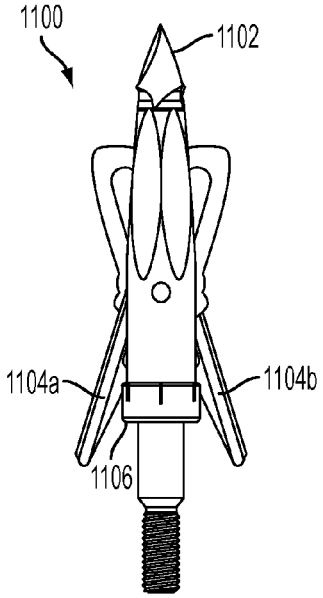
FIG. 11A depicts an exemplary side view of an expandable broadhead design with two side blades, a collar, and a four-facet chisel tip.
Figure 11B:
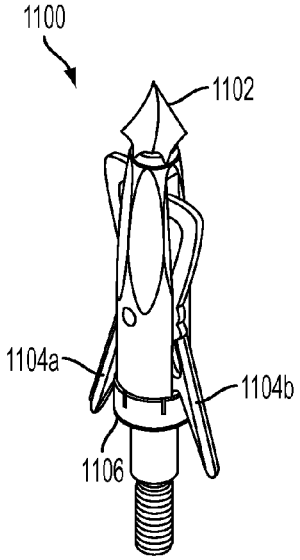
FIG. 11B depicts an exemplary perspective view of the expandable broadhead of FIG. 11A.
Figure 11C:
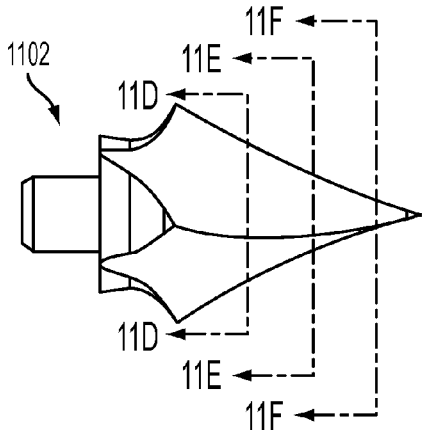
FIG. 11C depicts an exemplary side view of a four-facet chisel tip.
Figure 11D:
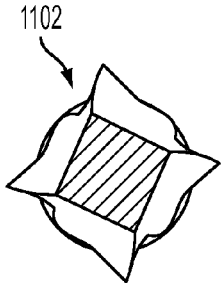
FIG. 11D depicts an exemplary cross-section view of a four-facet chisel tip, along line 11D-11D of FIG. 11C.
Figure 11E:
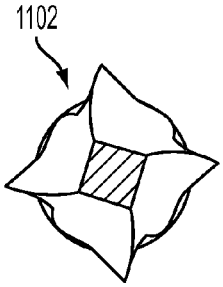
FIG. 11E depicts an exemplary cross-section view of a four-facet chisel tip, along line 11E-11E of FIG. 11C.
Figure 11F:
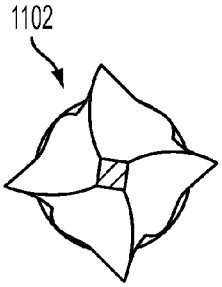
FIG. 11F depicts an exemplary cross-section view of a four-facet chisel tip, along line 11F-11F of FIG. 11C.
Figure 11G:
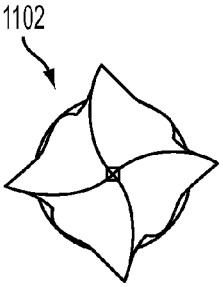
FIG. 11G depicts an exemplary end view of the four-facet chisel tip of FIG. 11C.
Figure 12A:
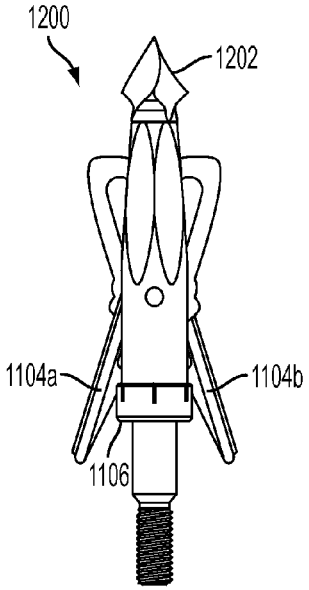
FIG. 12A depicts an exemplary side view of an expandable broadhead design with two side blades, a collar, and a three-facet chisel tip.
Figure 12B:
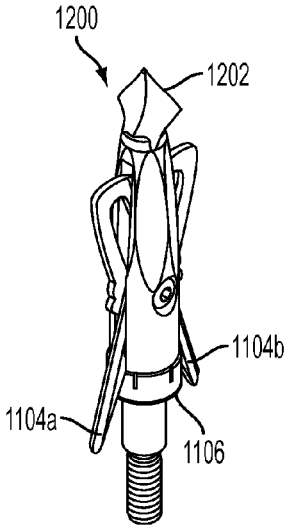
FIG. 12B depicts an exemplary perspective view of the expandable broadhead of FIG. 12A.
Figure 12C:
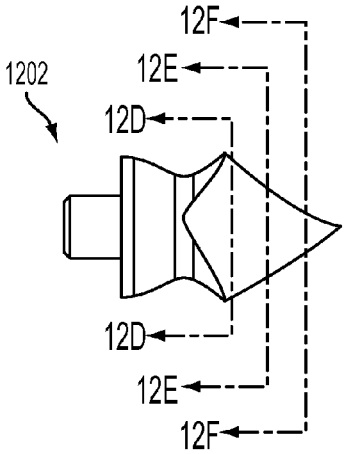
FIG. 12C depicts an exemplary side view of a three-facet chisel tip.
Figure 12D:
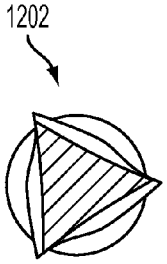
FIG. 12D depicts an exemplary cross-section view of a three-facet chisel tip, along line 12D-12D of FIG. 12C.
Figure 12E:
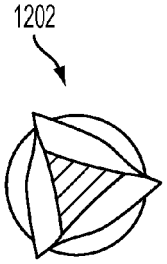
FIG. 12E depicts an exemplary cross-section view of a three-facet chisel tip, along line 12E-12E of FIG. 12C.
Figure 12F:
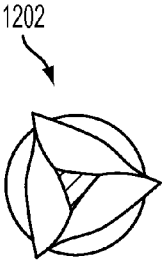
FIG. 12F depicts an exemplary cross-section view of a three-facet chisel tip, along line 12F-12F of FIG. 12C.
Figure 12G:
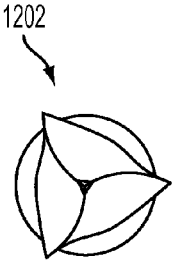
FIG. 12G depicts an exemplary end view of the three-facet chisel tip of FIG. 12C.

In a preferred embodiment of the present invention depicted by FIGS. 5A-5B, the ferrule body 516 of the expandable broadhead 500 includes at least one blade recess (such as shown in FIG. 11B) to receive, at least in part, a plurality of blades 504*a* and 504*b*. In certain embodiments, the one or more recesses for receiving the plurality of blades 504*a* and 504*b* consist of one or more slots (such as shown in FIG. 11B). In a preferred embodiment of the present invention, the ferrule body 516 also includes a nose section 507 and a rear section 509.

Figure 15A:
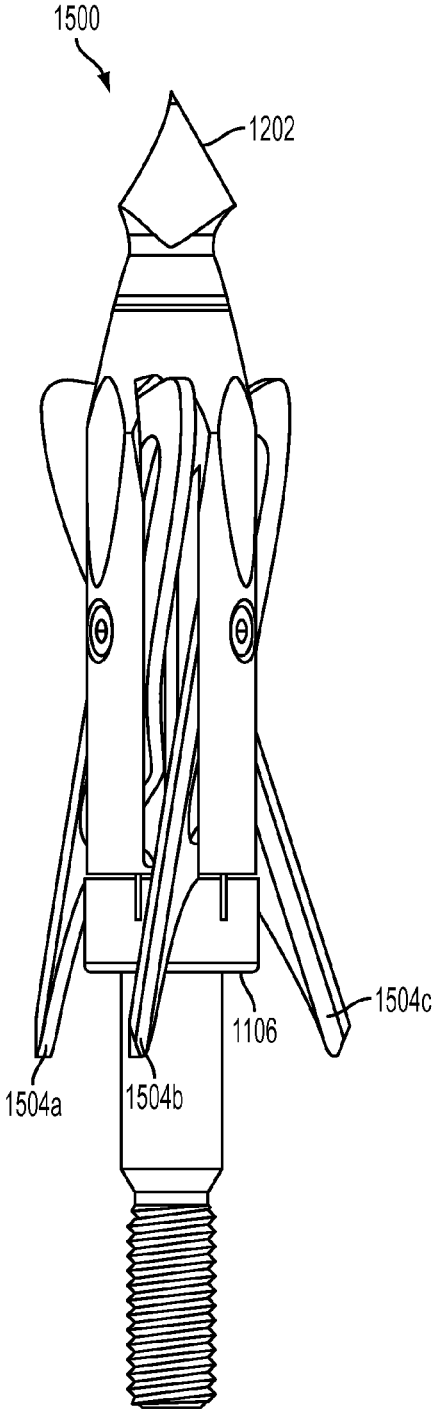
FIG. 15A depicts an exemplary side view of an expandable broadhead design with three side blades, a collar, and a three-facet chisel tip.
Figure 15B:
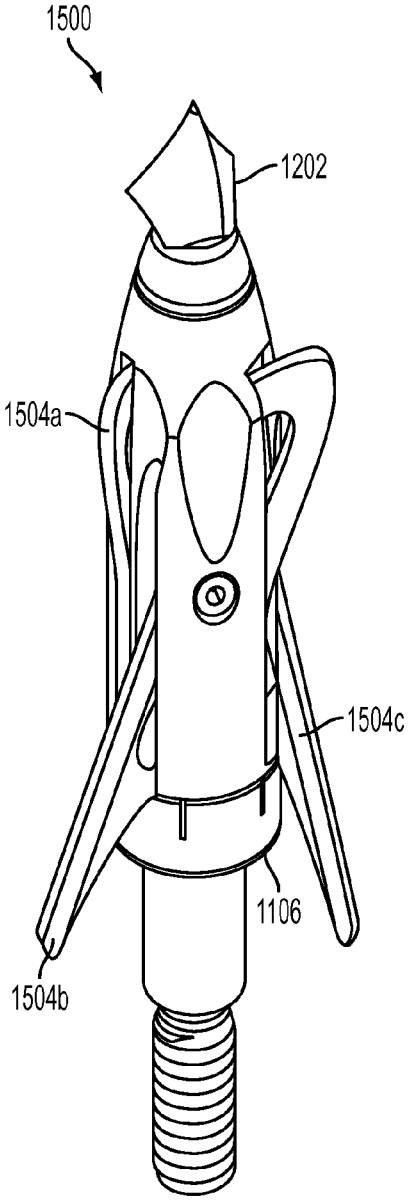
FIG. 15B depicts an exemplary perspective view of the expandable broadhead of FIG. 15A.

In certain preferred embodiments of the present invention, the ferrule body 516 of the broadhead design 500 is a unitary molded or machined structure that includes various slots (such as shown in FIG. 15B), facets 508, threads 518, and the like. In other embodiments, the ferrule body 516 may include a plurality of components that are assembled.

In a preferred embodiment of the present invention, the rear section 509 of the ferrule body 516 includes threads 518 that couple with a conventional arrow shaft (not shown) or other projectile, such as a crossbow bolt. In certain embodiments, the nose section 507 of the ferrule body 516 may take a variety of forms, including but not limited to a conical, faceted, or a straight tapered structure. In a preferred embodiment, the nose section 507 of the ferrule body 516 includes one or more facets or flat regions 508. The facets 508 increase the aerodynamic stability of the expandable broadhead 500 during flight, and in certain embodiments, the number of facets 508 may vary in accordance with various broadhead design factors.

In certain embodiments of the present invention, the ferrule body 516 includes one or more facets 508. The facets 508 can be either concave, convex, or a combination thereof. In one embodiment, the facets 508 are grooves or depressions arranged generally parallel to the longitudinal axis. In another embodiment, the facets 508 are ridges or protrusions. The facets 508 provide a number of functions, such as aerodynamics, stability of the expandable broadhead 500 as it penetrates a target, and the release of fluid pressure that may accumulate in front of the expandable broadhead 500.

The plurality of blades 504*a* and 504*b* of the present invention depicted in the exemplary broadhead design 500 can be referred to generically as cutting blades. In a preferred embodiment, the cutting blades 504*a* and 504*b* are rear deploying blades. As used herein, "rear deploying" refers to rearward translation of blades 504*a* and 504*b* generally along a longitudinal axis of the ferrule body 516 and outward movement of a rear portion of the blades 504*a* and 504*b* away from the longitudinal axis. The rearward translation can be linear, curvilinear, rotational or a combination thereof. In a preferred embodiment of the present invention, the rear deploying blades 504*a* and 504*b* are attached to the ferrule body 516 by a mechanism 510 that allows the blades 504*a* and 504*b* to move outward in a camming manner from the ferrule body 516 by a rearward translation that causes interaction between the ferrule body 516 and the blades 504*a*, 504*b*. In certain embodiments, the pivot feature 510 is a threaded fastener, including but not limited to a pin, which can be removed to permit replacement of the blades 504*a* and 504*b*.

In a preferred embodiment of the invention, the rear portion of a rear deploying blade 504*a* or 504*b* remains on the same side of a blade pivot axis in both the retracted and deployed configurations for the rear deploying blade 504*a* or 504*b*. An example of the movement of the rear deploying blades 504*a* and 504*b* is illustrated by U.S. Pat. No. 8,197,367, hereby incorporated herein in its entirety by reference. The shock-absorbing retainer 514 assists in retaining the rear deploying blades 504*a* and 504*b* in the retracted configuration until impact.

Figure 5C:
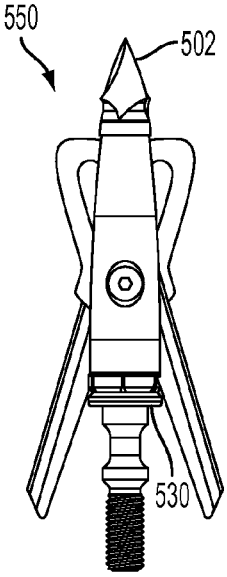
FIG. 5C depicts an exemplary side view of an expandable broadhead with a chisel tip, two side cutting blades, and a collar.

In a preferred embodiment, as illustrated by FIGS. 5A-5C, the rear deploying blades 504*a* and 504*b* include a blunt impact edge 506*a* and 506*b* and a sharp cutting edge 512*a* and 512*b*. In certain embodiments, including the exemplary embodiment illustrated in FIG. 5B, the rear deploying blades 504*a* and 504*b* include one or more cutouts 520*a* and 520*b*. The cutouts 520*a* and 520*b* serve to reduce the weight of the rear deploying blades 504*a* and 504*b*, to increase the strength and/or flexibility of the blades 504*a* and 504*b*, or to perform other functions.

In one or more preferred embodiments of the present invention, in the retracted configuration of the plurality of rear deploying blades 504*a* and 504*b*, the blunt impact edge 506*a* and 506*b* is positioned exterior to the ferrule body 516. Each of the plurality of rear deploying blades 504*a* and 504*b* is releasably coupled to the shock-absorbing retainer 514 to retain the rear deploying blades 504*a* and 504*b* in the retracted configuration. When the impact edge 506*a* and 506*b* contacts an object, the blades 504*a* and 504*b* release from the retainer 514 and the blades 504*a* and 504*b* are displaced rearward. As the blades 504*a* and 504*b* move rearward, the blades 504*a* and 504*b* move from the retracted configuration to the deployed configuration through camming between the blades and ferrule body.

Different deployment configurations are desirable for a variety of reasons, such as, for example, the nature of the target or type of game being hunted. In one embodiment of the present invention, the threaded fastener 510 preferably used as the pivot feature on the present invention's expandable broadhead 500 permits quick and easy substitution of blades 504*a* and 504*b* having different deployment configurations. In some embodiments, it may be advantageous to attach cutting blades having different deployment profiles to a single ferrule body 516.

In a preferred embodiment of the present invention, the shock-absorbing retainer 514 is made from a resilient or elastomeric material that absorbs some of the impact force between the rear deploying blades 504*a* and 504*b* and the ferrule body 516 in the deployed configuration of the blades 504*a* and 504*b*. In the preferred embodiment, the shock absorbing properties of the retainer 514 reduces blade failure in the deployed configuration. In another embodiment, the retainer 514 plastically deforms upon impact of the cutting blades 504*a* and 504*b*. The diameter of the retainer 514 can be selected based on the degree of impact absorption required, the configuration of the cutting blades 504*a* and 504*b*, and other factors. In an exemplary embodiment of the present invention, the retainer 514 can be constructed as a metal snap ring made from a softer metal than the rear deploying blades 504*a* and 504*b*. In another exemplary embodiment, the retainer 514 is constructed from a low surface friction material, such as, for example, nylon, HDPE (high-density polyethylene) or PTFE (polytetrafluoroethylene), to facilitate blade deployment.

In certain preferred embodiments of the invention, different types of shock-absorbing retainers can be used in the expandable broadhead design, as illustrated by the exemplary embodiment 550 of the present invention depicted in FIG. 5C, which features the same chisel tip 502 as the broadhead design 500 depicted in FIGS. 5A and 5B, but utilizes a different type of shock-absorbing retainer 530.

In another preferred embodiment of the present invention, the shock-absorbing retainer 514 is made from a polymeric material, and is used in conjunction with an O-ring to retain the rear deploying blades 504*a* and 504*b* in place during flight until impact. The polymeric material should be flexible enough to withstand normal handling without any breakage issues. Furthermore, the material must be flexible enough that it doesn't break when the retainer 514 is pushed into position during assembly. At the same time, the material of the retainer 514 should be brittle enough upon impact so that it releases the blades 504*a* and 504*b* in a rapid loading impact situation. The descriptive name for a material possessing these qualities is "strain rate sensitive." In a preferred embodiment of the present invention, the polymeric material is polypropylene.

The components of the expandable broadhead 500 can be manufactured using a variety of techniques. In one embodiment of the present invention, the ferrule body 516 and/or the rear deploying blades 504*a* and 504*b* are made using metal injection molding techniques. In another embodiment, the ferrule body 516 and/or the rear deploying blades 504*a* and 504*b* are manufactured using powder injection molding techniques. The powder mixtures used in either the metal injection molding or powder injection molding processes can include metals, ceramics, thermoset or thermoplastic resins, and composites thereof. Reinforcing fibers can optionally be added to the powder mixture.

In other embodiments of the present invention, the ferrule body 516 and/or the rear deploying blades 504*a* and 504*b* are made using other molding techniques, such as injection molding. The molding materials can include metals, ceramics, thermoset or thermoplastic resins, and composites thereof. Reinforcing fibers can optionally be added to the molding mixture. Suitable reinforcing fibers include glass fibers, natural fibers, carbon fibers, metal fibers, ceramic fibers, synthetic or polymeric fibers, composite fibers, or a combination thereof.

In certain embodiments of the present invention, the ferrule body 516 is made from a material selected from the group consisting of aluminum, titanium, magnesium, and carbon-fiber reinforced polymer. In a preferred embodiment of the present invention, the ferrule body 516 is made from aluminum. In another preferred embodiment of the present invention, the ferrule body 516 is made from titanium.

In certain embodiments of the present invention, the rear deploying blades 504*a* and 504*b* are cut from a sheet or blank of blade stock material. The blade stock material can be made from various different steels, including tool steels, stainless steels, high speed steel, carbon steels, carbides, titanium alloys, tungsten alloys, tungsten carbides, as well as other metals or any other suitable material that a cutting blade 504*a* or 504*b* could be fabricated from.

The expandable broadhead designs 500 and 550 of the present invention, as illustrated by FIGS. 5A-5C, also include a chisel tip 502. In a preferred embodiment of the present invention, the chisel tip 502 is a pressed in insert that is inserted into the neck section 507 of the ferrule body 516.

Figure 6A:
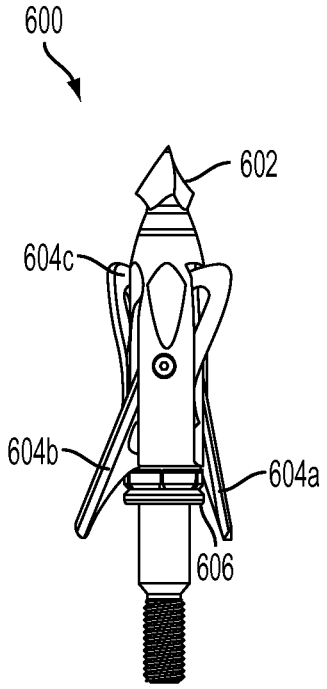
FIG. 6A depicts an exemplary side view of an expandable broadhead with a chisel tip, three side cutting blades, and a collar.
Figure 6B:
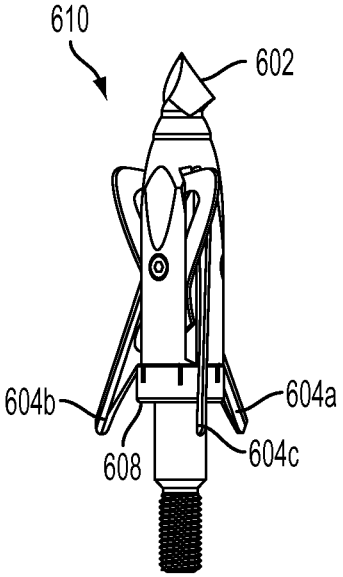
FIG. 6B depicts an alternate exemplary side view of the expandable broadhead shown in FIG. 6A.

In certain preferred embodiments of the present invention, as depicted by the exemplary side view of expandable broadhead 600 in FIG. 6A and the exemplary side view of expandable broadhead 610 in FIG. 6B, the expandable broadhead designs 600 and 610 may include a three-faceted chisel tip 602 and three rear deploying blades 604*a-c* releasably coupled to a shock-absorbing retainer 606 or 608.

Figure 7A:
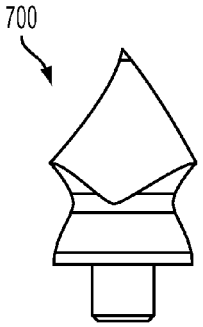
FIG. 7A depicts an exemplary side view of a three-facet chisel tip.
Figure 7B:
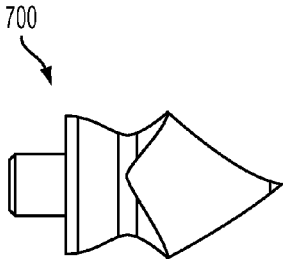
FIG. 7B depicts FIG. 7A when it is rotated ninety (90) degrees clockwise.
Figure 7C:
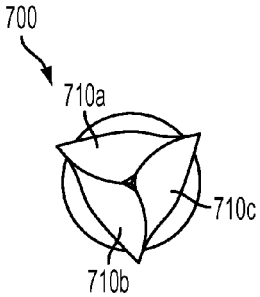
FIG. 7C depicts an exemplary top view of FIG. 7A.

FIGS. 7A-7C illustrate exemplary side and top views of a chisel tip 700 of a preferred embodiment of the present invention. In this preferred embodiment, the chisel tip 700 has three facets 710*a-c*, as depicted by the top view of the chisel tip 700 illustrated in FIG. 7C.

Figure 7D:
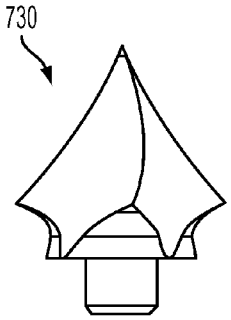
FIG. 7D depicts an exemplary side view of a four-facet chisel tip.
Figure 7E:
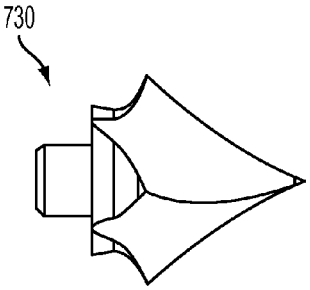
FIG. 7E depicts FIG. 7D when it is rotated ninety (90) degrees clockwise.
Figure 7F:
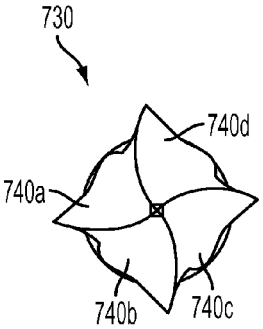
FIG. 7F depicts an exemplary top view of FIG. 7D.

FIGS. 7D-7F illustrate exemplary side and top views of a chisel tip 730 of another preferred embodiment of the present invention. In this preferred embodiment, the chisel tip 730 has four facets 740*a-d*, as depicted by the top view of the chisel tip 730 illustrated in FIG. 7F.

In certain embodiments of the present invention, the chisel tip 700 or 730 can be made from various different steels, including tool steels (M-2, S-7, and D-2), stainless steels (301, 304, 410, 416, 420, 440A, 440B, 440C, 17-4 PH, 17-7 PH, 13C26, 19C27, G1N4 and other stainless steels), high speed steel, carbon steels, carbides, titanium alloys, tungsten alloys, tungsten carbides, as well as other metals. In a preferred embodiment of the invention, the chisel tip 700 or 730 is made from stainless steel. The heightened density and weight of the larger steel structure of the chisel tip 700 or 730 in this embodiment, when compared to an aluminum or titanium (materials which are more lightweight and less dense than steel) ferrule body, leads to a center of mass on the projectile that has greater forward of center properties. Increasing the mass forward of center on a projectile is a well-established method of improving the flight characteristics of that projectile.

In certain embodiments of the present invention, the chisel tip 700 or 730 can be coated with a material selected from the group consisting of nickel, zinc, cadmium, and black oxide. In a preferred embodiment of the invention, the chisel tip 700 or 730 is coated with nickel. The tip can also be coated with a friction reducing coating such as a PTFE impregnated ceramic or fluoropolymer, PVD (physical vapor deposition) or CVD (chemical vapor deposition) ceramic type coating.

As illustrated by the exemplary embodiments displayed in FIGS. 7A-C and FIGS. 7D-F, preferred embodiments of the chisel tips 700 and 730 incorporate a helical design pattern for the cutting edges of the chisel tip 700 or 730's facets 710*a-c* and 740*a-d*, respectively. This spiraling helical pattern is also illustrated by the cross-sectional views of the exemplary three-facet chisel tip embodiment 800 displayed in FIGS. 8A-8E, as well as the cross-sectional views of the exemplary four-facet chisel tip embodiment 900 displayed in FIGS. 9A-9E. The helical pattern of the three-facet chisel tip 800's cutting edges 804*a-c*, as well as the helical pattern of the four-facet chisel tip 900's cutting edges 904*a-c*, directs the air flow around the ferrule body in the preferred embodiments of the present invention. The directed air flow leads to increased rotation of the broadhead projectile and reduces the effects of side winds in flight, stabilizing the flight path of the projectile to improve its flight characteristics and leading to enhanced accuracy and precision of arrow shots.

In addition to the helical design pattern illustrated by the exemplary embodiments displayed in FIGS. 7A-F, 8A-E, and 9A-E, both the three-facet and four-facet exemplary embodiments illustrated in these figures also include concave faces for the facets of the chisel tips 800 and 900. The concave facets of the chisel tips 800 and 900 in the preferred embodiments of the present invention lead to the points 802 and 902 of the chisel tips 800 and 900 and the cutting edges 804*a-c* and 904*a-d* separating the facets of the chisel tips 800 and 900 both being of a more acute angle than the cutting edges and point of a chisel tip with facets cut flat. The increased acuteness of the preferred embodiments' concave chisel tips 800 and 900's points 802 and 902 and cutting edges 804*a-c* and 904*a-d*, respectively, improve the penetration of the points 802 and 902 of the chisel tips 800 and 900 into a target or game animal and increase the sharpness of the cutting edges 804*a-c* and 904*a-d*.

Various embodiments of the present invention have varying numbers of cutting blades as well as different numbers of facets on the chisel tip. However, in preferred embodiments of the present invention, the number of facets of the chisel tip is a multiple of the number of cutting blades of the expandable broadhead.

Figure 10A:
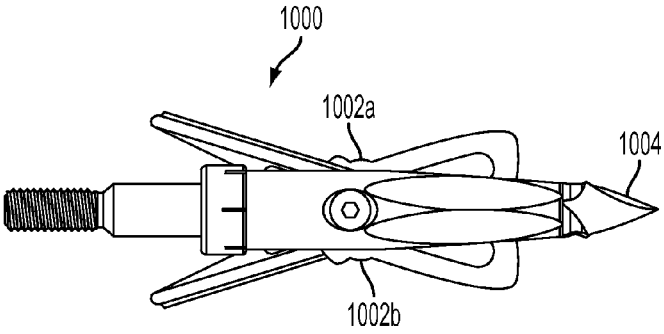
FIG. 10A depicts an exemplary side view of an expandable broadhead design with a four-facet chisel tip and two side cutting blades.
Figure 10B:
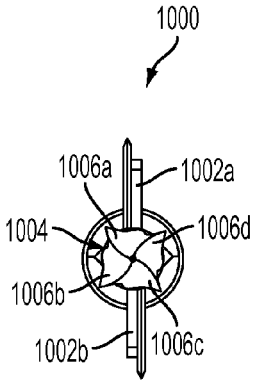
FIG. 10B depicts an exemplary end view of the expandable broadhead of FIG. 10A.
Figure 10C:
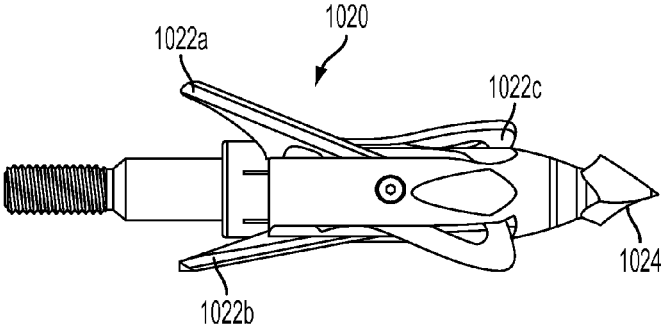
FIG. 10C depicts an exemplary side view of an expandable broadhead design with a three-facet chisel tip and three side cutting blades.
Figure 10D:
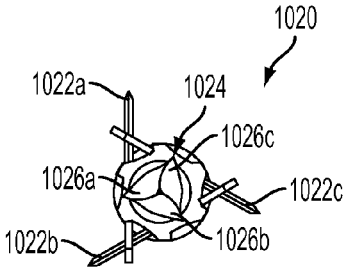
FIG. 10D depicts an exemplary end view of the expandable broadhead of FIG. 10C.
Figure 10E:
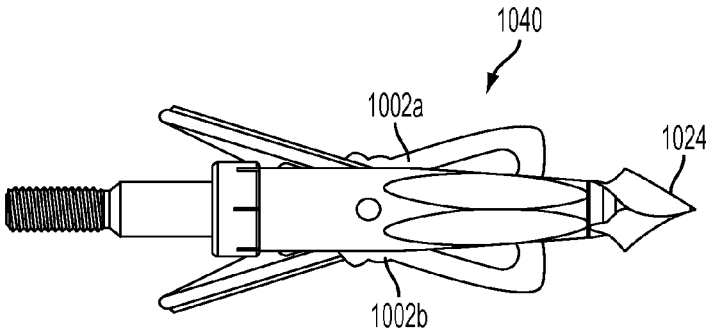
FIG. 10E depicts an exemplary side view of an expandable broadhead design with a three-facet chisel tip and two side cutting blades.
Figure 10F:
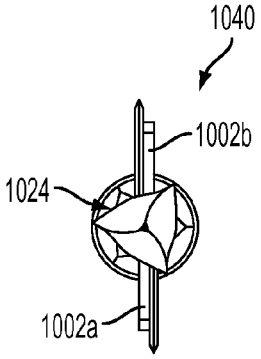
FIG. 10F depicts an exemplary end view of the expandable broadhead of FIG. 10E.
Figure 10G:
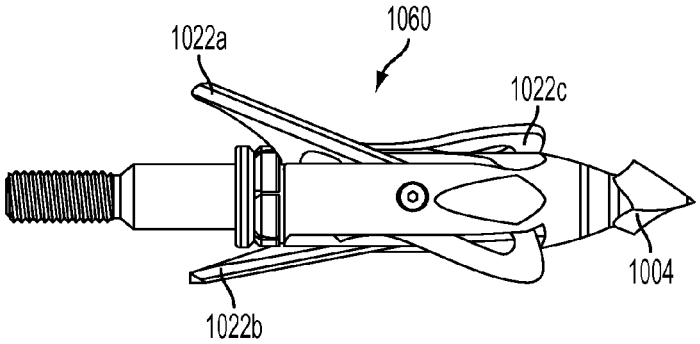
FIG. 10G depicts an exemplary side view of an expandable broadhead design with a four-facet chisel tip and three side cutting blades.
Figure 10H:
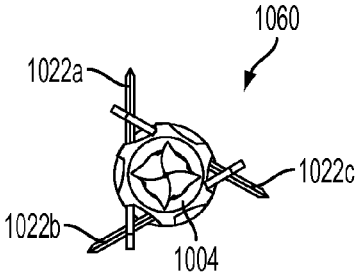
FIG. 10H depicts an exemplary end view of the expandable broadhead of FIG. 10G.

For example, in a preferred embodiment, an expandable broadhead with two cutting blades would be tipped with a chisel tip with two, four, six, etc. facets. Such a preferred embodiment is illustrated by FIGS. 10A-B, displaying an expandable broadhead 1000 with two cutting blades 1002*a-b* and a four-facet 1006*a-d* chisel tip 1004. In another preferred embodiment, an expandable broadhead with three cutting blades would be tipped with a chisel tip with three, six, nine, etc. facets. Such a preferred embodiment is illustrated by FIGS. 10C-D, displaying an expandable broadhead 1020 with three cutting blades 1022*a-c* and a three-facet 1026*a-c* chisel tip 1024. However, other embodiments of the present invention can include any combination of an amount of cutting blades and number of chisel tip facets. FIGS. 10E-F illustrate an exemplary embodiment of an expandable broadhead 1040 that has two cutting blades 1002*a-b* and a three-facet chisel tip 1024, and FIGS. 10G-H illustrate an exemplary embodiment of an expandable broadhead 1060 that has three cutting blades 1022*a-c* and a four-facet chisel tip 1004.

In the preferred embodiments of the present invention, in which the number of facets of the chisel tip is a multiple of the number of cutting blades, by controlling the rotational angle of insertion of the chisel tip relative to the principal axes of the ferrule body, the facets of the chisel point can be positioned so that the cutting edges between the facets provide a complementary set of cutting edges to the primary cutting blades of the expandable broadhead. As illustrated by the exemplary view of the expandable broadhead design 1020 depicted in FIG. 10D, the angle of rotation of the chisel tip 1024 in preferred embodiments of the present invention should be such that the cutting edges of the chisel tip 1024 approximately bisect the separation angle of the cutting blades 1022*a-c*.

The complementary positioning of the chisel tip's cutting edges in relation to the cutting blades of the expandable broadhead in the preferred embodiments of the invention leads to several unique performance enhancements over previous expandable broadhead designs. The complementary placement of the chisel tip's cutting edges in relation to the cutting blades leads to a greater number of incisions made by the expandable broadhead, leading to maximum effectiveness in cutting.

Furthermore, deployment of the cutting blades works best when the leading blunt edges of those retracted blades strike the hide of a targeted game animal on impact. By offsetting the alignment of the chisel tip's cutting edges with the alignment of the rear deployed cutting blades, the preferred embodiments ensure that the blunt edges of the retracted blades strike uncut portions of the animal's hide, causing the retracted blades to effectively deploy and expose their sharp cutting edges.

In addition to the functional improvements of the chisel tip, in a preferred embodiment, the contours of the chisel tip are arranged and configured to flow into adjoining contours of the ferrule body, creating an aesthetically pleasing design.

In certain embodiments of the present invention, the expandable broadhead has a cutting diameter of about 1 inch to about 2.5 inches in diameter, when the blades are in an expanded position. In a preferred embodiment, the expandable broadhead has a cutting diameter of about 2 inches, when the blades are in an expanded position. In another preferred embodiment of the present invention, the expandable broadhead has a cutting diameter of about 1.5 inches, when the blades are in an expanded position.

In certain embodiments of the present invention, the expandable broadhead has a weight of about 75 grains to about 150 grains. In a preferred embodiment, the expandable broadhead has a weight of about 100 grains. In another preferred embodiment of the present invention, the expandable broadhead has a weight of about 125 grains.

The following Examples are only illustrative. It will be readily seen by one of ordinary skill in the art that the present invention fulfills all of the objectives set forth above. After reading the foregoing specification, one of ordinary skill will be able to effect various changes, substitutions of equivalents, and various other embodiments of the invention as broadly disclosed therein. It is therefore intended that the protection granted herein be limited only by the definition contained in the appended claims and equivalents thereof.

EXAMPLES

Example 1

An expandable broadhead 1100 with a chisel tip 1102 as illustrated by FIGS. 11A-11G, that includes two side cutting blades 1104*a-b*, a collar 1106, and a four-facet chisel tip 1102 with concave facets and helical cutting edges.

Example 2

An expandable broadhead 1200 with a chisel tip 1202 as illustrated by FIGS. 12A-12G, that includes two side cutting blades 1104*a-b*, a collar 1106, and a three-facet chisel tip 1202 with concave facets and helical cutting edges.

Example 3

Figure 13A:
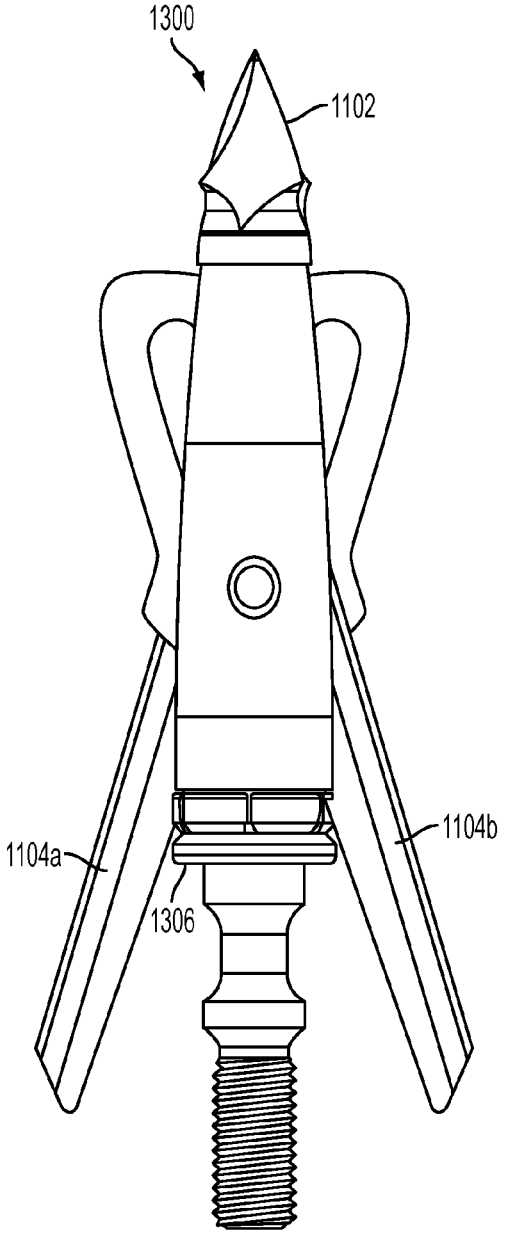
FIG. 13A depicts an exemplary side view of an expandable broadhead design with two side blades, a collar, and a four-facet chisel tip.
Figure 13B:
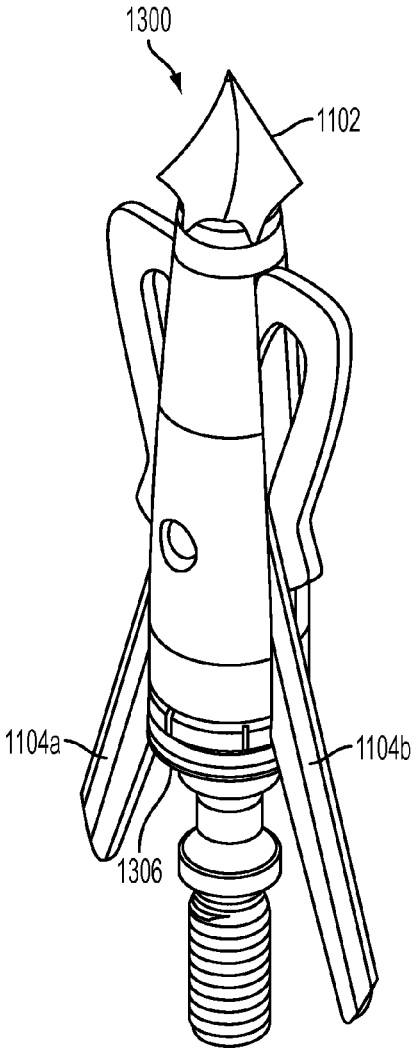
FIG. 13B depicts an exemplary perspective view of the expandable broadhead of FIG. 13A.

An expandable broadhead 1300 as illustrated by FIGS. 13A-13B, having two side cutting blades 1104*a-b*, a collar 1306, and a four-facet chisel tip 1102 with concave facets and helical cutting edges, as shown in FIGS. 11C-G.

Example 4

Figure 14A:
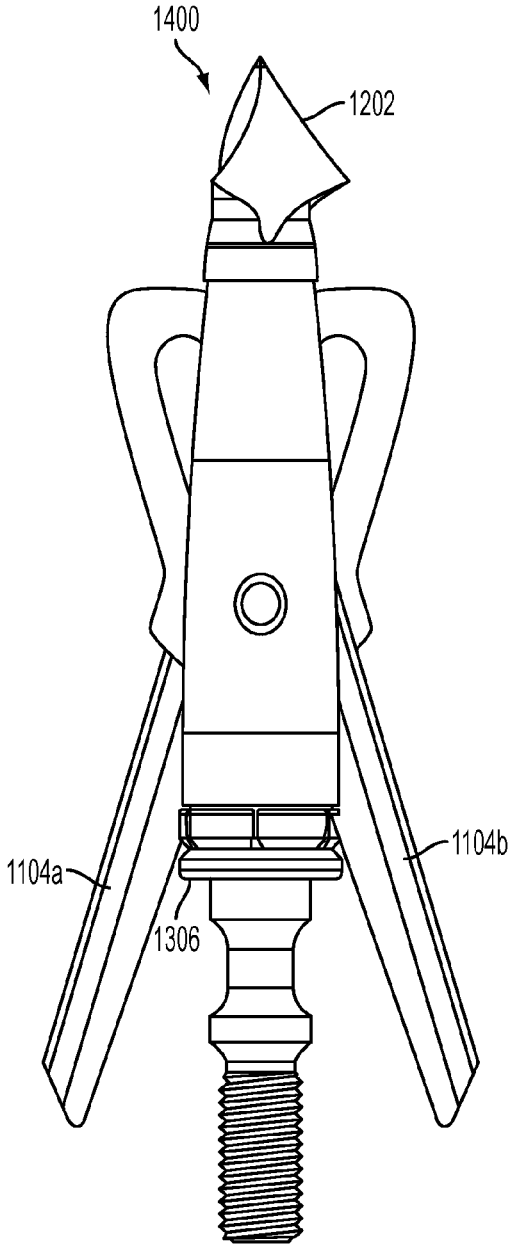
FIG. 14A depicts an exemplary side view of an expandable broadhead design with two side blades, a collar, and a three-facet chisel tip.
Figure 14B:
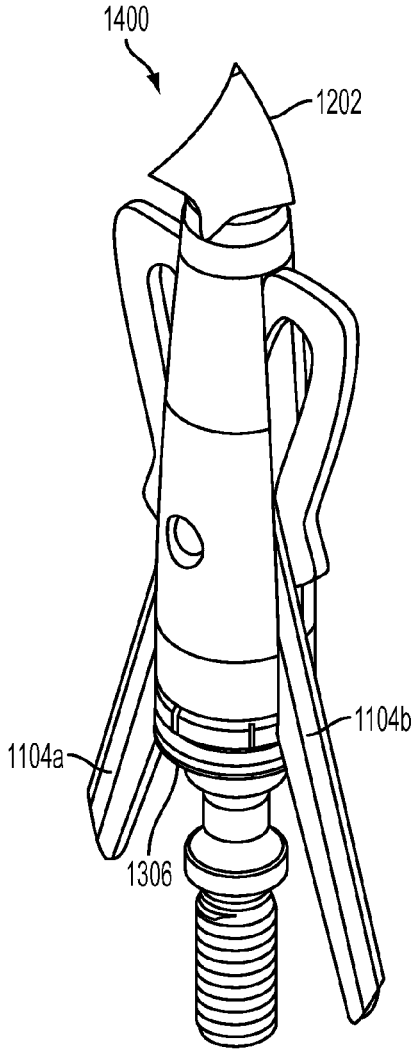
FIG. 14B depicts an exemplary perspective view of the expandable broadhead of FIG. 14A.

An expandable broadhead 1400 as illustrated by FIGS. 14A-14B, having two side cutting blades 1104*a-b*, a collar 1306, and a three-facet chisel tip 1202 with concave facets and helical cutting edges, as shown in FIGS. 12C-G.

Example 5

An expandable broadhead 1500 as illustrated by FIGS. 15A-15B, having three side cutting blades 1504*a-c*, a collar 1106, and a three-facet chisel tip 1202 with concave facets and helical cutting edges, as shown in FIGS. 12C-G.

Example 6

Figure 16A:
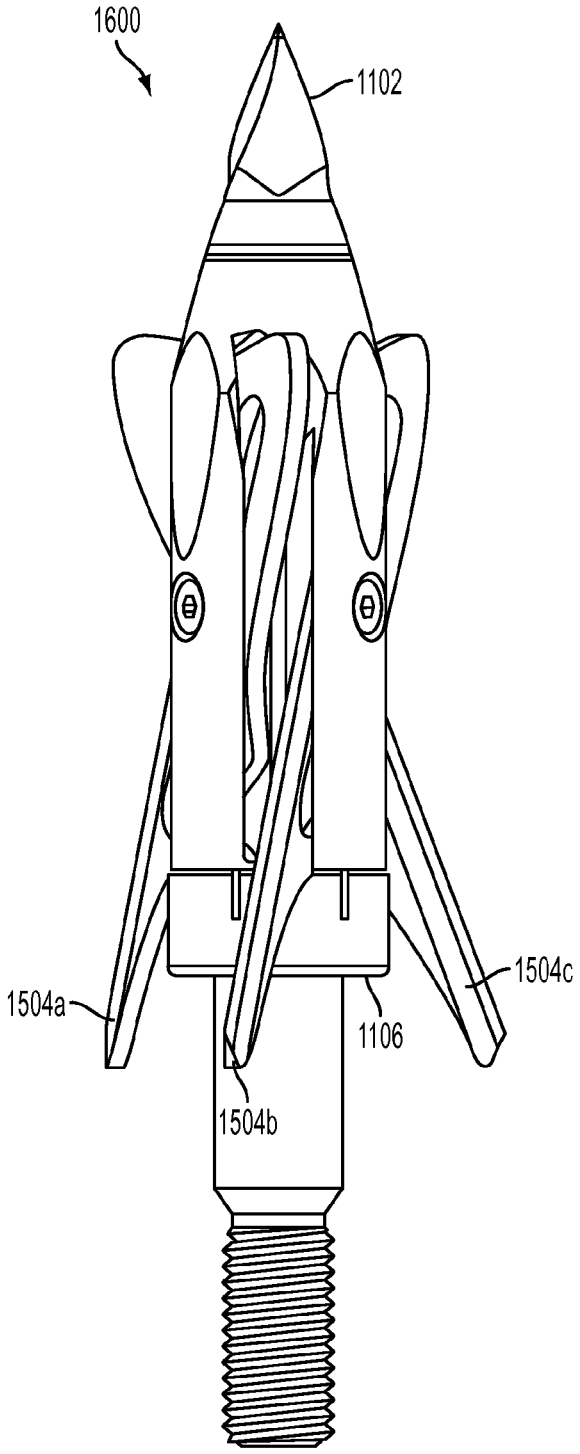
FIG. 16A depicts an exemplary side view of an expandable broadhead design with three side blades, a collar, and a four-facet chisel tip.
Figure 16B:
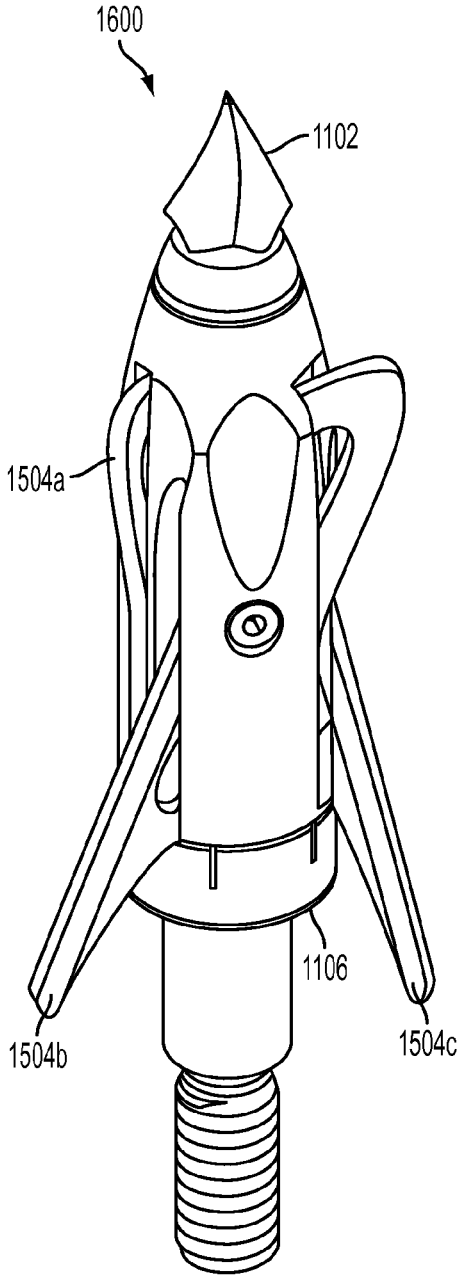
FIG. 16B depicts an exemplary perspective view of the expandable broadhead of FIG. 16A.

An expandable broadhead 1600 as illustrated by FIGS. 16A-16B, having three side cutting blades 1504*a-c*, a collar 1106, and a four-facet chisel tip 1102 with concave facets and helical cutting edges, as shown in FIGS. 11C-G.

Example 7

Figure 17A:
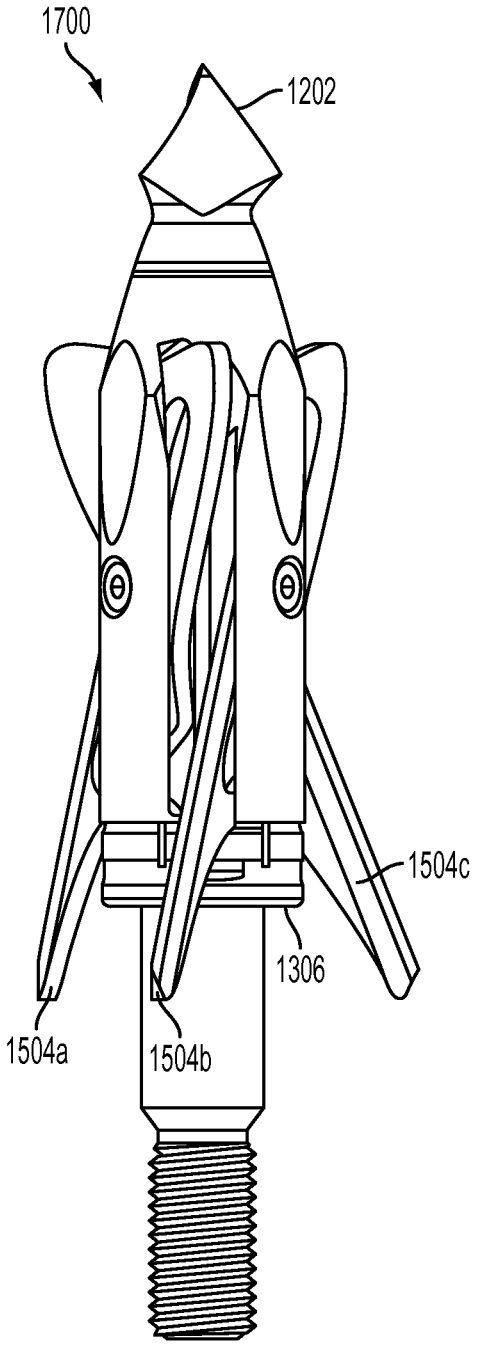
FIG. 17A depicts an exemplary side view of an expandable broadhead design with three side blades, a collar, and a three-facet chisel tip.
Figure 17B:
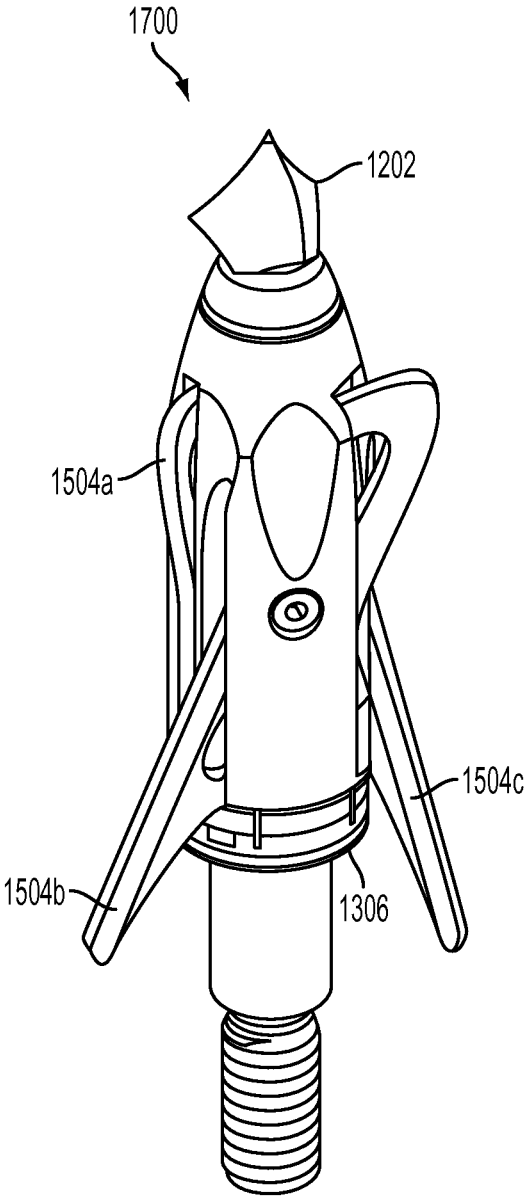
FIG. 17B depicts an exemplary perspective view of the expandable broadhead of FIG. 17A.

An expandable broadhead 1700 as illustrated by FIGS. 17A-17B, having three side cutting blades 1504*a-c*, a collar 1306, and a three-facet chisel tip 1202 with concave facets and helical cutting edges, as shown in FIGS. 12C-G.

Example 8

Figure 18A:
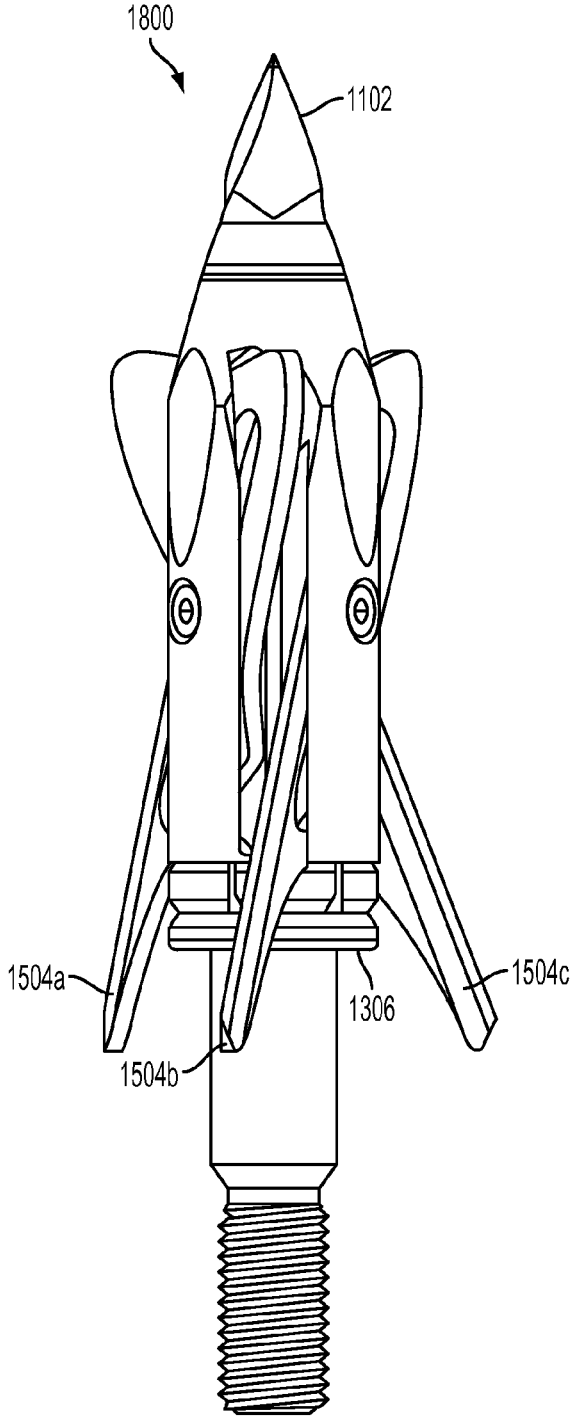
FIG. 18A depicts an exemplary side view of an expandable broadhead design with three side blades, a collar, and a four-facet chisel tip.
Figure 18B:
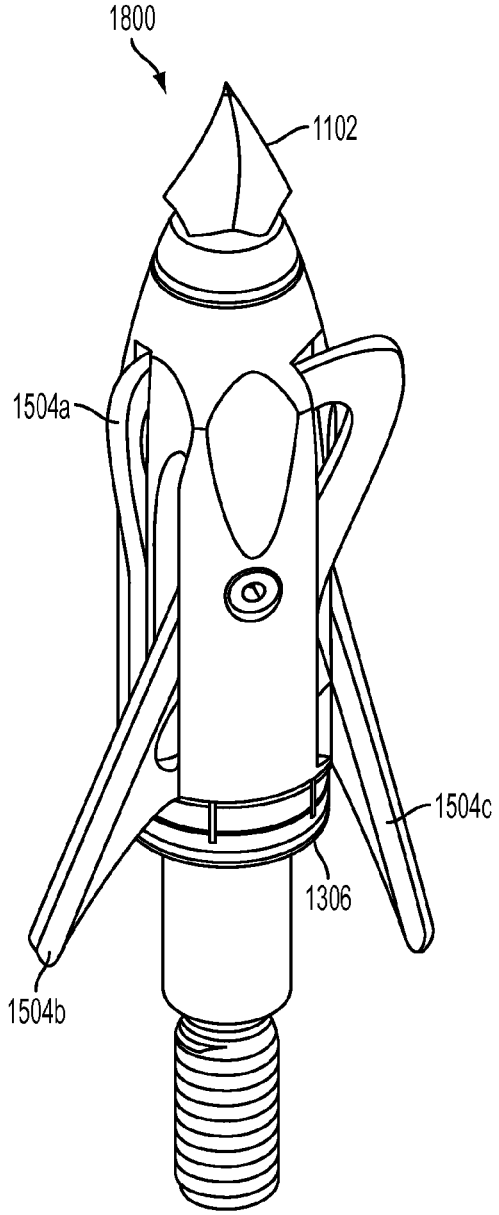
FIG. 18B depicts an exemplary perspective view of the expandable broadhead of FIG. 18A.

An expandable broadhead 1800 as illustrated by FIGS. 18A-18B, having three side cutting blades 1504*a-c*, a collar 1306, and a four-facet chisel tip 1102 with concave facets and helical cutting edges, as shown in FIGS. 11C-G.

What is claimed is:

1. An expandable broadhead, comprising:

a ferrule body comprising a nose section and at least one blade recess;

a multi-faceted chisel tip inserted into the nose section of the ferrule body, comprising tip cutting edges between the facets of the chisel tip;

a plurality of rear-deploying blades residing at least in part in the at least one blade recess, wherein each rear-deploying blade comprises a blade blunt edge and a blade cutting edge, the blades being rearwardly longitudinally translatable from a retracted, in flight position to an extended, penetrating position, the longitudinal translation of the plurality of blades effecting an outward movement of a rear portion of the blades away from a longitudinal axis of the ferrule body; and wherein the tip cutting edges are aligned to be offset from the blade cutting edges of the plurality of rear-deploying blades.

2. The expandable broadhead of claim 1, wherein the ferrule body comprises at least one of aluminum, titanium, magnesium, and carbon-fiber reinforced polymer.

3. The expandable broadhead of claim 1, wherein the chisel tip comprises at least one of a stainless steel, a tool steel, a carbide, a titanium alloy, a tungsten alloy, and a tungsten carbide.

4. The expandable broadhead of claim 3, wherein the chisel tip is coated with a material comprising at least one of nickel, zinc, cadmium, and black oxide.

5. The expandable broadhead of claim 1, wherein the chisel tip is coated with a friction reducing material comprising at least one of a PTFE (polytetrafluoroethylene), a fluoropolymer, a PVD (physical vapor deposition) ceramic type coating, and a CVD (chemical vapor deposition) ceramic type coating.

6. The expandable broadhead of claim 1, further comprising a shock-absorbing retainer, releasably engaged with the plurality of blades, to retain the blades in the retracted configuration until impact.

7. The expandable broadhead of claim 1, wherein the blade cutting edge of each of the plurality of blades is exposed in the deployed configuration of the plurality of blades.

8. The expandable broadhead of claim 7, wherein the blade blunt edge of each of the plurality of blades is exposed in the retracted configuration of the plurality of blades.

9. The expandable broadhead of claim 1, wherein the chisel tip comprises three facets.

10. The expandable broadhead of claim 1, wherein the chisel tip is comprised of a first material, the ferrule body is comprised of a second material, and the first material has a higher density than the second material.

11. An expandable broadhead, comprising:

a ferrule body comprising a nose section and at least one blade recess;

a plurality of rear-deploying blades residing at least in part in the at least one blade recess, wherein each rear-deploying blade comprises a blade blunt edge and a blade cutting edge, the blades being attached to the ferrule body by a pin that allows the blade cutting edges to move outward in a camming manner from the ferrule body by a rearward translation; and a multi-faceted chisel tip inserted into the nose section of the ferrule body, comprising tip cutting edges, between the facets of the chisel tip, aligned to be offset from the blade cutting edges of the plurality of rear-deploying blades.

12. The expandable broadhead of claim 11, wherein the ferrule body comprises at least one of aluminum, titanium, magnesium, and carbon-fiber reinforced polymer.

13. The expandable broadhead of claim 11, wherein the chisel tip comprises at least one of a stainless steel, a tool steel, a carbide, a titanium alloy, a tungsten alloy, and a tungsten carbide.

14. The expandable broadhead of claim 13, wherein the chisel tip is coated with a material comprising at least one of nickel, zinc, cadmium, and black oxide.

15. The expandable broadhead of claim 11, wherein the chisel tip is coated with a friction reducing material comprising at least one of a PTFE (polytetrafluoroethylene), a fluoropolymer, a PVD (physical vapor deposition) ceramic type coating, and a CVD (chemical vapor deposition) ceramic type coating.

16. The expandable broadhead of claim 11, further comprising a shock-absorbing retainer, releasably engaged with the plurality of blades, to retain the blades in the retracted configuration until impact.

17. The expandable broadhead of claim 11, wherein the blade cutting edge of each of the plurality of blades is exposed in the deployed configuration of the plurality of blades.

18. The expandable broadhead of claim 17, wherein the blade blunt edge of each of the plurality of blades is exposed in the retracted configuration of the plurality of blades.

19. The expandable broadhead of claim 11, wherein the chisel tip comprises three facets.

20. The expandable broadhead of claim 11, wherein the chisel tip is comprised of a first material, the ferrule body is comprised of a second material, and the first material has a higher density than the second material.

* * * * *